US005425439A

United States Patent [19]

Tsuchida

[11] Patent Number: 5,425,439

[45] Date of Patent: Jun. 20, 1995

[54] COIN ESCALATOR

[75] Inventor: Tamotsu Tsuchida, Saitama, Japan

[73] Assignee: Asahi Seiko Kabushiki Kaisha, Tokyo, Japan

[21] Appl. No.: 204,662

[22] Filed: Mar. 2, 1994

[51] Int. Cl.[6] ..... G07F 1/04

[52] U.S. Cl. ..... 194/344; 193/DIG. 1

[58] Field of Search ..... 194/344; 453/9; 221/267; 193/DIG. 1

[56] References Cited

U.S. PATENT DOCUMENTS 917,629 4/1909 Long ..... 194/344 X 5,170,874 12/1992 Abe ..... 194/344

FOREIGN PATENT DOCUMENTS 469886 7/1992 European Pat. Off. .

*Primary Examiner*—F. J. Bartuska

*Attorney, Agent, or Firm*—Sughrue, Mion, Zinn, Macpeak and Seas

[57] ABSTRACT

An escalator avoids jamming by preventing the edges of coins 5 from colliding with a path plate 4 in a curved portion 2 of the escalator, and prevents the deformation of the escalator by increasing the strength of the curved portion. The path plate, at the curved portion of the escalator, has a strengthening recess or trough 6 that extends along the direction in which coins pass, such that the upper ends of coins passing through the curved portion do not collide with the path plate.

11 Claims, 9 Drawing Sheets

COIN ESCALATOR

BACKGROUND OF THE INVENTION

1. Field of the Invention

This invention, which is used in gaming machines, vending machines and the like, relates to a coin escalator for passing coins from a first location to a second location.

2. Description of the Background Art

The construction of a coin escalator of the prior art is illustrated in FIG. 10, and comprises a path plate 4, holding plates 7 and spacers 8, thus defining a path for the passage of coins. This type of coin escalator is used, for example, by connecting it to a coin dispenser 11 as shown in FIG. 6.

Normally, escalator 1 connected to coin dispenser 11 extends at an inclination to the vertical without extending in the horizontal direction due to structural reasons relating to the coin dispenser (to be explained forthwith). Thus, as shown in FIG. 6, in order to reduce the space S in the depth direction inside the gaming machine or vending machine in which the escalator is incorporated, there are times when the direction in which the escalator extends must be changed by providing a curved portion 2 in it.

For structural reasons the rotary disc used for dispensing coins is inclined with respect to the horizontal in order to dispense coins by efficiency picking them up while in the bulk state. The construction of this type of coin dispenser is disclosed in detail in, for example, Japanese Examined Patent Publication Nos. 62-45588 and 63-36040.

In addition, an escalator is used not only to move coins from a low location to a high location, but also to move coins from one location to another location on the same level. In this case as well, there are times when the direction in which the escalator extends must be changed, and a curved portion is provided for this purpose as well.

However, the following problems are encountered when a curved portion is provided in an escalator. Namely, if the interval between the path plate and holding plates is too small with respect to the dimensions of passing coins, the upper end of the coin collides with the path plate preventing it from moving, thus resulting in coins becoming jammed in the escalator. In order to prevent this jamming, it is necessary to provide an interval W3 between path plate 4 and holding plates 7 at curved portion 2 of a size considerably larger than the thickness of passing coins 5 as shown in FIG. 7. Although it is necessary to widen this interval W3 the smaller the radius of curvature of curved portion 2, new problems are encountered if the interval is made excessively wide. That is, the upper end 5*a* of a following coin rides up onto the lower end 5*b* of a preceding coin, thus resulting in jamming within the coin path as shown in FIG. 8.

An example of a means for solving this problem is the apparatus disclosed in Japanese Utility Model Laid-Open Publication No. 61-107076. As shown in FIG. 9, slot 12 is provided in path plate 4 of curved portion 2 of escalator 1 extending along the direction in which coins 5 pass. In other words, coins are prevented from colliding with path plate 4 as a result of the edge of passing coins 5 escaping outside coin path 9 from slot 12. However, a problem is encountered in this case as well relating to the strength of curved portion 2. Namely, since the strength of curved portion 2 having slot 12 is lower than that of other portions, when a large load is applied to the escalator, the curved portion 2 ends up being deformed. In particular, there are numerous cases in which escalator 1 is grabbed and lifted up with the body of coin dispenser 11 hanging down, when transporting the apparatus with the escalator connected to the coin dispenser or when installing it in a gaming machine. Coin dispenser 11 typically weighs roughly 4–6 kg. When this weight is applied to curved portion 2 of the escalator, the curved portion becomes bent or deformed. As a result, the interval between the path plate and holding plates ends up widening, thus causing coins to become jammed as described above.

In addition, when the length of escalator 1 is increased in order to move coins to a higher location, curved portion 2 ends up receiving the weight of the escalator itself as well as the weight of coins 5 contained therein. If this weight exceeds a fixed limit which can be supported, the curved portion again becomes deformed in the same manner as in the previous example.

Thus, the problem which the present invention solves is to prevent the jamming of coins resulting from the edges of the coins colliding with the path plate of the curved portion of the escalator, and to prevent the deformation of the escalator by increasing the strength of the curved portion.

SUMMARY OF THE INVENTION

An escalator of the present invention contains a curved portion; a linear portion may or may not be present. The escalator has a path plate, and is configured to allow coins to pass along the path plate, whose curved portion contains a recess or trough extending along the direction in which the coins pass. This recess may extend to not only the curved portion, but also to a linear portion when the escalator has one. Alternatively, the recess may only extend to a point part way in the curved portion.

Instead of providing a recess, similar effects can be obtained by making the right and left sides of the path plate thicker than the central portion. The path plate may also be equipped with holding rollers according to an alternate embodiment and various other forms can be employed.

The cross-section of the of escalator recess in the width direction of the coin path is roughly in the shape of the letter "U". This may also be a "V" shape, or a squared letter "U". In any case, the shape of the recess is arbitrary provided it allows the upper ends of moving coins to escape to the outside of the path.

The width W1 of the escalator recess is smaller than the diameter W2 of passing coins. In addition, the recess is provided in the central portion of the path along which coins pass, but it may be shifted to either the right or left side from this central portion.

First, by providing the recess in the path plate of the curved portion of the escalator extending along the direction in which coins pass, the upper ends of moving coins are prevented from colliding with the path plate and becoming jammed in the escalator. Secondly, the jamming of coins caused by the deformation of the escalator is prevented by increasing the strength of the curved portion.

DESCRIPTION OF THE PREFERRED EMBODIMENTS

Figure 1:
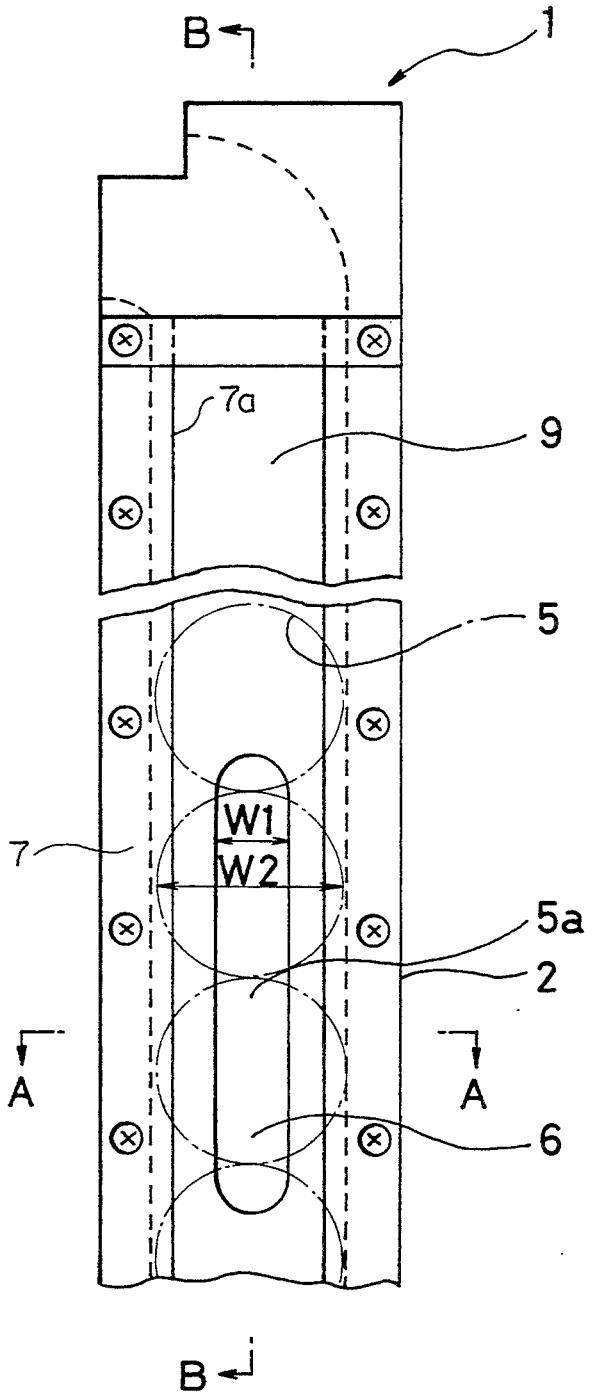
FIG. 1 is a front view showing a first embodiment of the present invention.
Figure 2:
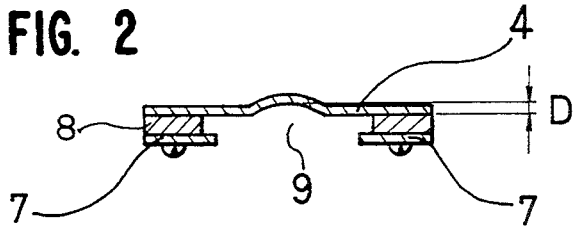
FIG. 2 is a cross-sectional view taken along line A—A of FIG. 1.
Figure 3:
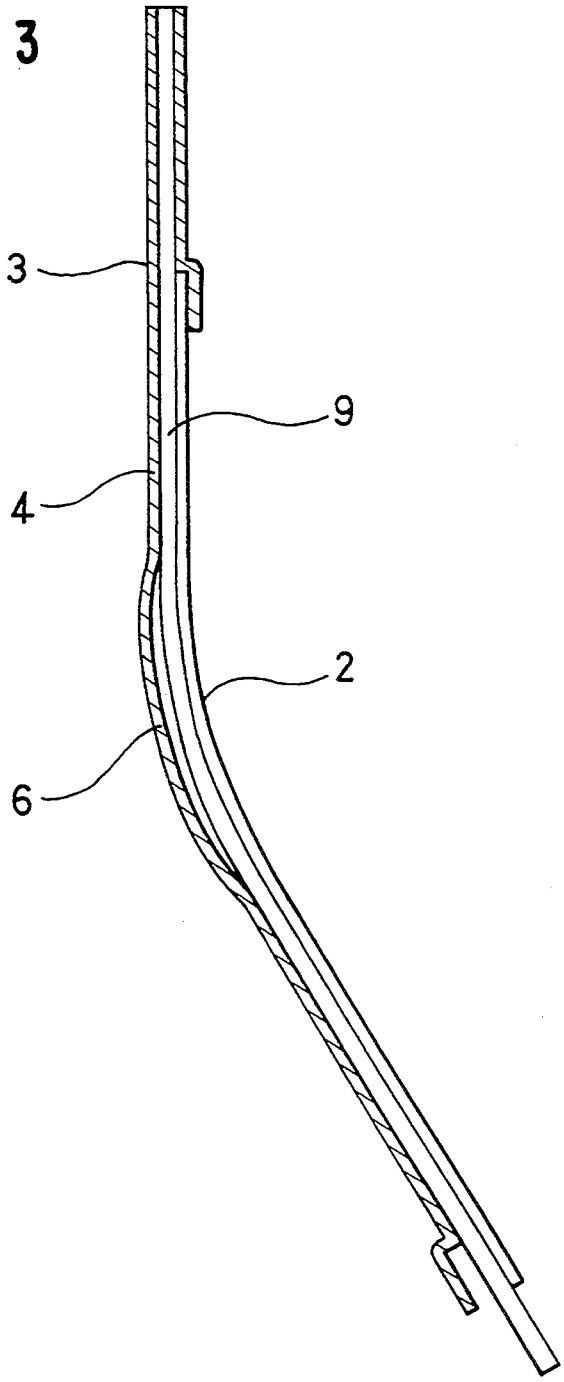
FIG. 3 is a cross-sectional view taken along line B—B of FIG. 1.

Referring to FIGS. 1, 2 and 3, escalator 1 is composed of path plate 4, holding plates 7 and spacers 8. Path plate 4 and holding plates 7 face each other with spacers in between, and are mutually connected by screws or welding, etc. These components define coin path 9, which has sufficient size to allow the movement of at least one coin.

The size of coin path 9 can be adjusted according to the mounting positions and thickness of spacers 8. Namely, a coin path 9 suitable for the passage of large diameter coins can be made by widening the interval between spacers 8, while conversely, one suitable for the passage of small diameter coins can be made by narrowing the interval between the spacers. In addition, paths suitable for thick or thin coins can be made by increasing or reducing the thickness of the spacers.

Furthermore, path plate 4, holding plates 7 and spacers 8 may be independent members, or in the form of a single integrated member. Moreover, although central openings 7*a* of holding plates 7 in the embodiments are provided primarily for the purpose of cleaning the inside of coin path 9, these may or may not be provided. In other words, it is unrelated to the invention whether the holding plates 7 are in the form of a single plate or in the form of two separate plates.

Curved portion 2 of path plate 4 has a recess or trough 6 extending along the direction in which coins 5 pass. Fabrication of this recess 6 is performed by press forming of path plate 4. However, the recess is obviously not required to be fabricated by this method, and any method may be employed.

Recess 6 may extend to a linear portion 3 from curved portion 2, in which case the linear and curved portions can be reinforced together.

Figure 2A:
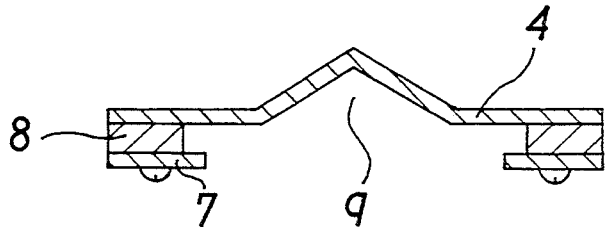
FIG. 2A is a cross-sectional view, similar to FIG. 2, showing a V-shaped recess.
Figure 2B:
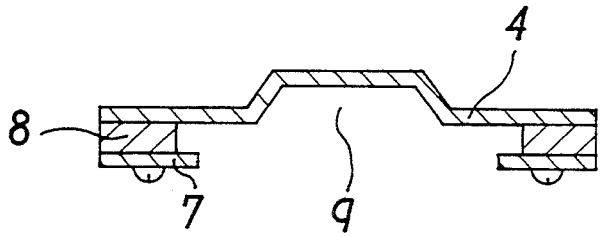
FIG. 2B is a cross-sectional view, similar to FIG. 2, showing a squared U-shaped recess.

Although the cross section of recess 6 in the present embodiment is roughly in the shape of the letter "U", it may also be in the shape of the letter "V" as in FIG. 2A or a squared letter "U" as in FIG. 2B. In any case, the cross section of recess 6 is sufficient provided it allows the upper end 5*a* of passing coins to escape to the outside of path 9.

The width W1 of recess 6 is smaller than the diameter W2 of passing coins 5, and prevents the coins from falling through. As long as the upper end 5*a* of a passing coin is able to escape to the outside of coin path 9, width W1 of recess 6 may be wider or narrower than that shown in the drawings, and the width at one location may be different from that at another location.

The depth D of recess 6 is also not limited to that shown, but may be deeper or shallower depending on the location. The center of the recess may also be shifted to the right or left from the center of the escalator.

Passing coins 5 are of various sizes, ranging from small to large. For example, a large coin is the U.S. $1.00 coin (diameter: 38 mm, thickness: 2.5 mm), while a small coin is the U.S. 25¢ piece (diameter 24.6 mm, thickness: 1.7 mm). If the width W1 of recess 6 used for these coins is set at 14 mm and its depth is set at 1 mm, the upper ends 5*a* of the coins are able to escape to the inside of recess 6, thus allowing the coins to pass smoothly through the curved portion of the escalator.

In the case of using stainless steel having a thickness of 1–1.5 mm for path plate 4, although deformation will result if an escalator of the prior art not provided with a recess is subjected to a load of 4–6 kg (namely, the weight of the coin dispenser body), by providing a recess 6 of the dimensions described above, this type of deformation will no longer occur.

Figure 4:
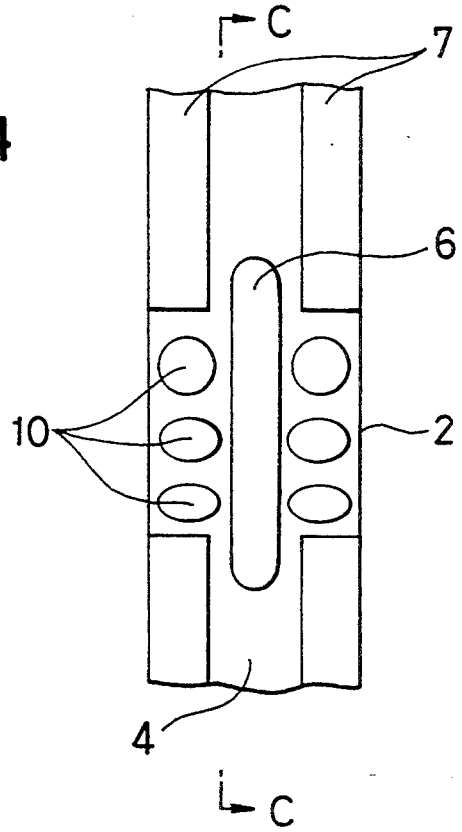
FIG. 4 is a front view showing a second embodiment of the present invention.
Figure 5:
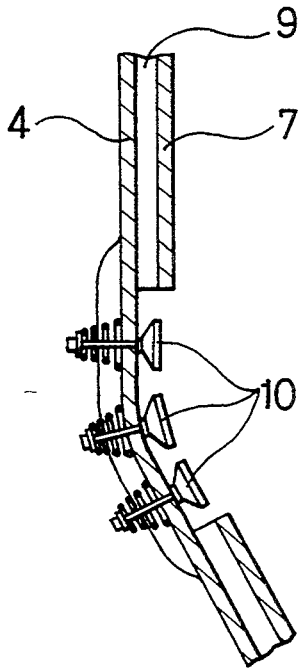
FIG. 5 is a cross-sectional view taken along line C—C of FIG. 4.
Figure 6:
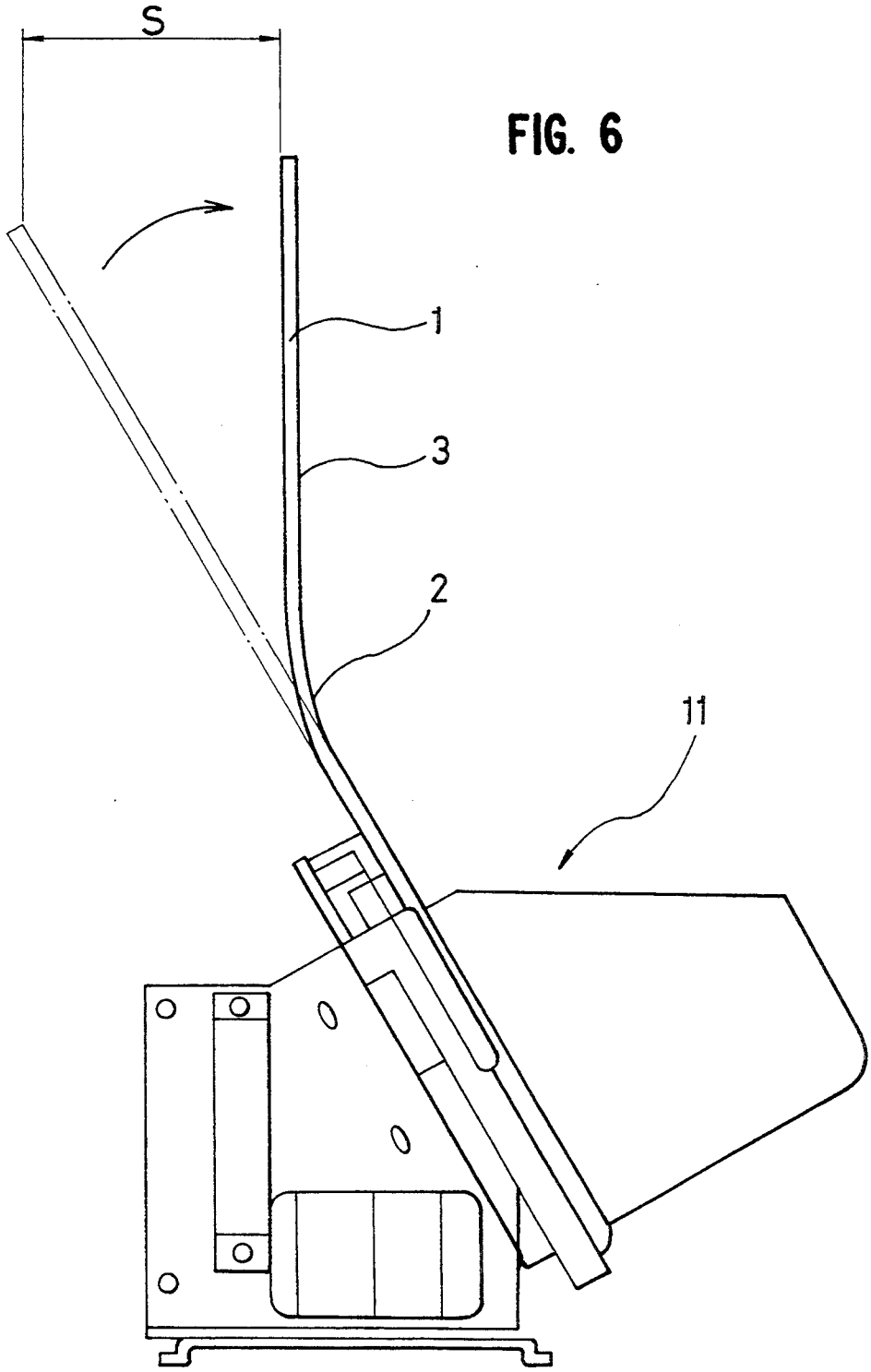
FIG. 6 is a left side view of an escalator attached to a coin dispenser.
Figure 7:
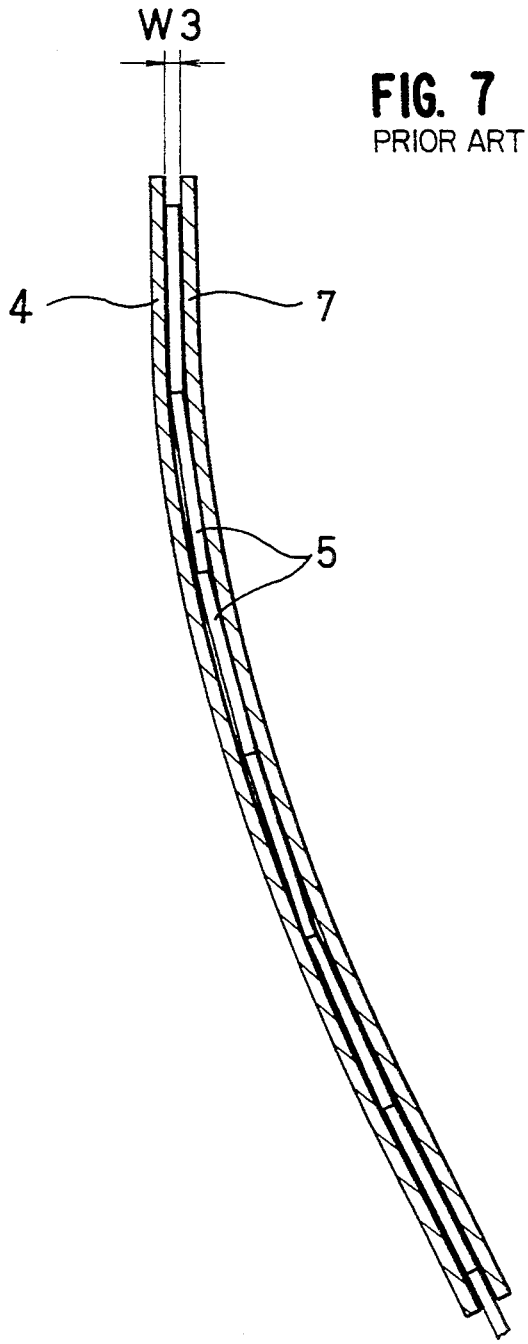
FIG. 7 PRIOR ART
FIG. 7 is a cross-sectional view of an escalator of the prior art.
Figure 8:
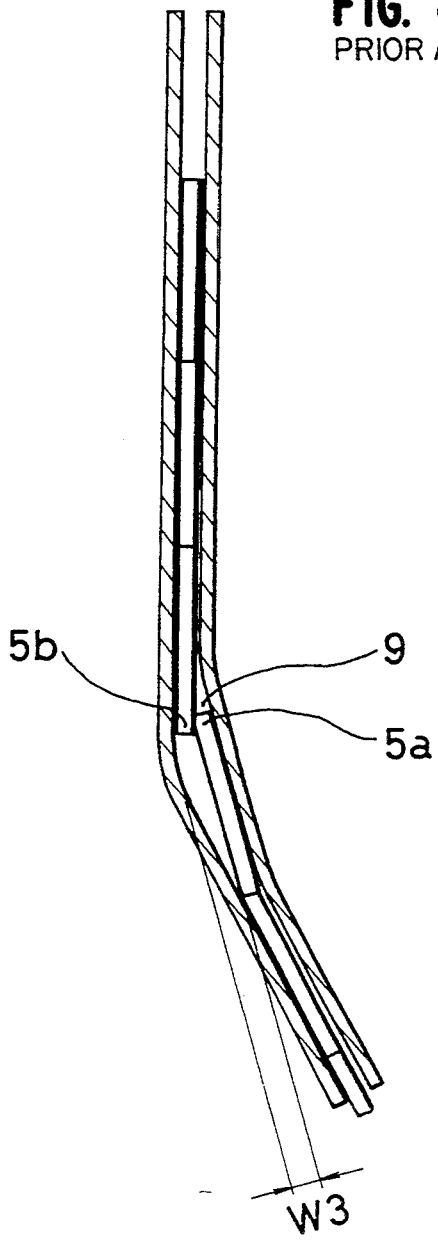
FIG. 8 PRIOR ART
FIG. 8 is a cross-sectional view of another escalator of the prior art.
Figure 9:
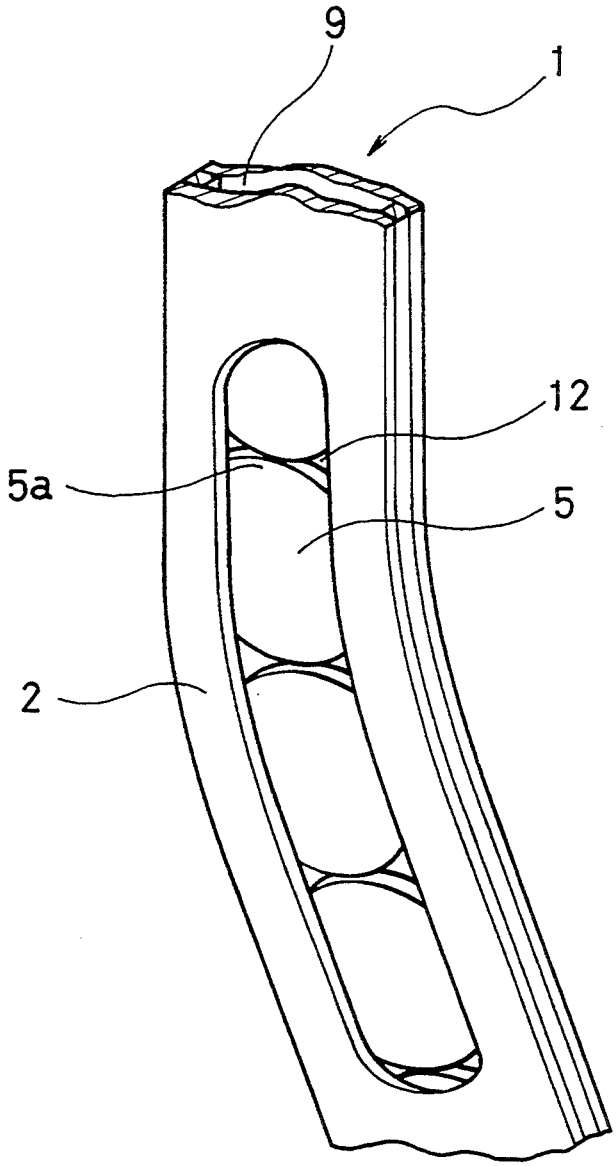
FIG. 9 PRIOR ART
FIG. 9 is a perspective view of an escalator representing the prior art.
Figure 10:
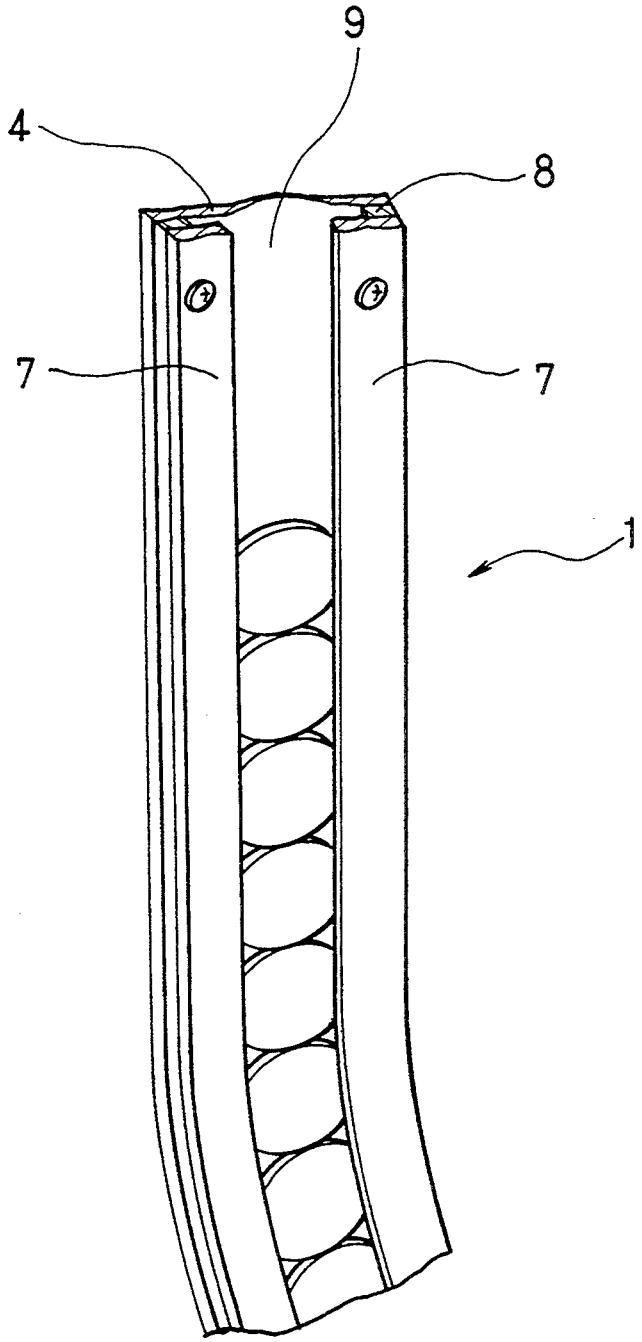
FIG. 10 PRIOR ART
FIG. 10 is another escalator of the prior art.

Referring to the embodiment based on FIGS. 4 and 5, the curved portion 2 of the escalator is composed of path plate 4 and holding rollers 10, while the holding plates 7 have been removed. The bottom surfaces of the holding rollers 10 which make contact with coins 5 are inclined towards path plate 4 and push on the coins so that they do not drop. If recess 6 is provided in the curved portion 2 of the escalator composed in this fashion, the jamming of coins caused by the deformation of the escalator can be prevented by increasing the strength of the curved portion 2 in the same manner as in the first embodiment.

Details of the holding rollers 10 are described in Japanese Laid-Open Patent Publication No. 4-174096.

Since the curved portion of the escalator in the present invention is reinforced, its deformation can be prevented. Consequently, coins within the escalator are able to move smoothly.

What is claimed is:

1. An elongate coin escalator having a curved portion, and configured to allow the passage of coins from a first location to a second location along a path plate (4), wherein said path plate at said curved portion defines an outwardly projecting, elongate recess (6) extending along the direction of coin passage, and wherein the cross-section of said recess in the direction of the width of the path plate is approximately in the shape of one of the letter "U" the letter "V" and a squared letter "U".

2. The coin escalator as set forth in claim 1, wherein the width of said recess is smaller than the diameter of passing coins.

3. The coin escalator as set forth in claim 2, wherein said recess is provided in a central portion of said path plate.

4. An elongate coin escalator, comprising:

a curved portion extending between and interconnecting two straight portions, and configured to allow the conveyance of coins from a first location to a second location along a path plate (4), and means for preventing jamming between successively conveyed coins, and for strengthening the curved portion of the escalator, said preventing and strengthening means comprising an outwardly projecting, elongate recess (6) defined in and extending along the curved portion of the path plate in a direction of coin conveyance.

5. The coin escalator as set forth in claim 4, wherein the cross-section of said recess in the direction of the width of the path plate is approximately in the shape of the letter "U".

6. The coin escalator as set forth in claim 4, wherein the width of said recess is smaller than the diameter of passing coins.

7. The coin escalator as set forth in claim 6, wherein said recess is provided in a central portion of said path plate.

8. An elongate coin escalator, comprising:

an elongate path plate (4), and holding means (7; 10) extending along opposite sides of the path plate and spaced therefrom to define a coin conveyance passage (9) therewith configured to allow the passage of coins from a first location to a second location along the path plate, wherein said path plate at a curved portion thereof defines an outwardly projecting, elongate recess (6) extending along a direction of coin passage to prevent jamming between successively conveyed coins and to strengthen the curved portion.

9. The coin escalator as set forth in claim 8, wherein the cross-section of said recess in the direction of the width of the coin conveyance passage is approximately in the shape of the letter "U".

10. The coin escalator as set forth in claim 8, wherein the width of said recess is smaller than the diameter of passing coins.

11. The coin escalator as set forth in claim 10, wherein said recess is provided in a central portion of said path plate.

* * * * *